US005174212A

United States Patent [19]

Judy

[11] Patent Number: 5,174,212

[45] Date of Patent: Dec. 29, 1992

[54] METHOD AND APPARATUS FOR CONTROLLING TRAIN POSITIONERS USING MOTOR ENERGY TO DETERMINE THE MASS OF THE TRAIN AND THE MASS OF THE TRAIN TO DETERMINE MAXIMUM DECELERATION

[75] Inventor: R. Mark Judy, Jefferson County, Ohio

[73] Assignee: Svedala Industries, Incorporated, Pittsburgh, Pa.

[21] Appl. No.: 866,813

[22] Filed: Apr. 9, 1992

[51] Int. Cl.[5] ..... B61B 12/10

[52] U.S. Cl. ..... 104/162; 104/176; 104/178; 198/718; 318/274

[58] Field of Search ..... 104/162, 176, 178, 179; 198/718; 318/270, 274, 277

[56] References Cited

U.S. PATENT DOCUMENTS

| | | | |
|---|---|---|---|
| 3,128,271 | 4/1964 | McGowan | 104/162 |
| 3,212,454 | 10/1965 | Ludwig | 104/176 |
| 3,260,220 | 7/1966 | Ludwig | 104/176 |
| 3,262,399 | 7/1966 | Ludwig | 104/176 |
| 3,312,886 | 4/1967 | Mitchell | 318/204 |
| 3,381,628 | 5/1968 | Lambeth et al. | 104/162 |
| 3,695,185 | 10/1972 | Rose | 104/176 |
| 3,942,451 | 3/1976 | Modliszewski | 104/176 |
| 4,006,691 | 2/1977 | Kacir et al. | 104/176 |
| 4,038,927 | 8/1977 | Evans | 104/162 |
| 4,078,191 | 3/1978 | Morters et al. | 318/227 |
| 4,181,197 | 1/1980 | Tanabe et al. | 187/29 |
| 4,225,813 | 9/1980 | Sahasrabudhe | 318/371 |
| 4,354,792 | 10/1982 | Cornish | 414/359 |
| 4,460,862 | 7/1984 | Espinosa et al. | 318/741 |
| 4,512,260 | 4/1985 | Manning, Jr. et al. | 104/252 |
| 4,637,316 | 1/1987 | Carroll | 104/176 |
| 4,777,420 | 10/1988 | Dadpey et al. | 318/758 |
| 4,864,211 | 9/1989 | Kawaguchi | 318/626 |
| 4,914,366 | 4/1990 | Yuasa et al. | 318/612 |
| 4,926,755 | 5/1990 | Seiford, Sr. | 104/183 |
| 5,058,505 | 10/1991 | Uehira | 104/284 |

FOREIGN PATENT DOCUMENTS

| | | | |
|---|---|---|---|
| 1253900 | 2/1986 | U.S.S.R. | 198/718 |

*Primary Examiner*—Robert J. Oberleitner
*Assistant Examiner*—S. Joseph Morano
*Attorney, Agent, or Firm*—Webb, Burden, Ziesenheim & Webb

[57] ABSTRACT

A method and apparatus for operating a train positioner for moving one or more railroad cars of a unit train are disclosed. The positioner is engaged with the train while the positioner is stopped at an initial location. The positioner is moved and the train is accelerated to a constant speed. The energy expended by the positioner in accelerating the train to the constant speed is determined and apparent mass of the train is calculated from this energy. From the apparent mass of the train, a maximum force to which the positioner should be subjected, and a deceleration rate, a deceleration point adequate to stop the train by a predetermined, final location is calculated. The positioner is decelerated beginning at the deceleration point and at the deceleration rate until the train is stopped by a final location. In a preferred embodiment, the deceleration rate is also calculated from the apparent mass of the train and the maximum force to which the positioner should be subjected.

23 Claims, 5 Drawing Sheets

METHOD AND APPARATUS FOR CONTROLLING TRAIN POSITIONERS USING MOTOR ENERGY TO DETERMINE THE MASS OF THE TRAIN AND THE MASS OF THE TRAIN TO DETERMINE MAXIMUM DECELERATION

BACKGROUND OF THE INVENTION

1. Field of the Invention

This invention relates to train positioners for moving one or more railroad cars into position for loading or unloading of the cars and, more particularly, to control systems for such train positioners.

2. Background Art

The use of train positioners for automatically and sequentially moving one or more railroad cars of a multi-car unit train is well known in the art. For example, a train positioner can be used to move the railroad cars, such as open-topped hopper or gondola-type railroad cars, through a rotary car dumper. The cars are typically equipped with rotary couplings, are rotated about a longitudinal axis within the car dumper and the contents therein dumped out without being uncoupled.

A wide variety of train positioners are known in the field. See, for example, the devices disclosed in U.S. Pat. Nos. 3,212,454; 3,260,220; 3,262,399; 3,695,185; 3,942,451; 4,006,691; 4,038,927; 4,354,792; 4,512,260; 4,637,316; and 4,926,755. A typical train positioner is shown in U.S. Pat. No. 3,212,454 and includes an elongated carriage trackway positioned along one side of the train tracks and, typically, upstream of a dumping station or the like. A positioner carriage is moved along the carriage track in a controlled manner and carries thereon a positioner arm which can be moved into and out of engagement with a coupler between adjacent railroad cars. With the positioner arm in a vertical position, the positioner is moved to an initial or starting location on the carriage trackway. The positioner arm is then moved to a substantially horizontal position in contact with the coupler. The positioner carriage is then moved along the carriage trackway and, through the contact of the positioner arm with the coupler, moves the entire unit train along the train tracks through a predetermined distance, typically one or more train car lengths. After the positioner carriage has stopped at a final location, the positioner arm is moved to a vertical position out of contact with the coupler and the positioner carriage is returned to the starting location. The cycle described above is repeated sequentially and automatically until the entire train has been moved through the dumping station.

In a typical control operation, the positioner carriage is moved from a stopped mode at the starting location, through an acceleration period and then to a constant, running speed. The positioner carriage is then moved along the carriage trackway at the constant running speed until a preset location or point is reached for initiating deceleration. This preset point is typically identified by a limit switch which sends a control signal to an appropriate controller or the like. The positioner carriage is then slowed through a deceleration mode at a predetermined rate until the positioner carriage reaches and is stopped at the final location on the carriage trackway. The initial and final locations of the positioner carriage along the carriage trackway are typically identified by limit switches or the like.

One of the drawbacks with a preset or fixed deceleration point and rate system is that the deceleration point must be placed far enough upstream of the final location so that the positioner carriage can adequately stop the train during the most severe loads, i.e., when the train is fully loaded and at its greatest mass. However, the mass of the train actually changes from cycle to cycle as the individual railroad cars are either loaded or unloaded. For example, as the train becomes lighter during continued unloading of cars, the preset deceleration point provides a deceleration distance longer than is needed to stop the train. This gap between the preset deceleration distance and that actually needed to stop the train becomes even longer as the train is further unloaded and, hence, lightened in weight. Substantial operation time is wasted by fixing the deceleration distance at a constant and maximum length to cover the extreme train weight which exists for only a short period of time.

In addition, the forces to which the positioner arm is subjected during the acceleration and, particularly, deceleration operations can be rather severe. This was not a great problem when unit trains used conventional absorbing or slack-type couplings. The couplings in the train would absorb most if not all of the excess energy when the train was decelerated by the positioner. However, the trend in modern trains is to use more rigid or slackless couplings in which there is little or no give or free play between the attached railroad cars. Therefore, all of the energy which must be dissipated during the deceleration mode of operation is imparted on the positioner and its coupling arm. For prior positioners designed with a fixed deceleration point arrangement and for conventional couplings, the positioners often cannot withstand the forces to which they are subjected from unit trains using slackless couplings.

A variety of positioning and motor control systems are known in the art. See, for example, U.S. Pat. Nos. 3,312,886; 4,078,191; 4,181,197; 4,225,813; 4,460,862; 4,777,420; 4,864,211; and 4,914,366. However, none of these references provide any teachings which would overcome the disadvantages with the known train positioners as discussed above.

Therefore, it is an object of the present invention to overcome the disadvantages of the prior train positioner control arrangements. In particular, it is an object of the present invention to provide a train positioner in which the deceleration point and deceleration rate are set in accordance with the changing demands from the changes of the train during operation. In addition, it is an object of the present invention to dissipate all or substantially all of the energy of the train during the deceleration operation so that the positioner is not subject to excessive or damaging forces.

SUMMARY OF THE INVENTION

Accordingly, I have developed a method and apparatus for operating a train positioner for moving one or more railroad cars of a unit train. In accordance with my invention, for each index cycle of the positioner, the positioner is engaged with the train while the positioner is stopped at an initial location. Thereafter, the positioner is moved and the train is accelerated to a constant speed. The energy expended by the positioner in accelerating the train to the constant speed is determined and the apparent mass of the train is calculated from this energy. From the apparent mass of the train, a maximum force to which the positioner should be subjected, and a deceleration rate, a deceleration point adequate to stop the train by a predetermined, final location is calculated. Then the positioner is decelerated beginning at the deceleration point and at the deceleration rate until the train is stopped by a final location. In a preferred embodiment, the deceleration rate is also calculated from the apparent mass of the train and the maximum force to which the positioner should be subjected.

The energy expended by the positioner in accelerating the train to the constant speed can be determined by measuring, over the time period of acceleration, the power expended by a motive power source for the positioner. In one embodiment, the motive power source is an electric motor and the energy expended by the motor is determined by measuring the current and voltage of the motor, multiplying the current and voltage to give the power of the motor, and integrating the measured power over the time period of acceleration. The deceleration point can be determined by calculating a deceleration distance from the positioner's desired final location, and a safety distance can be added to the calculated deceleration distance in arriving at the deceleration point.

In a preferred embodiment, the speed of the positioner is monitored and the constant speed of the positioner is established at a predetermined full speed if the measured speed of the positioner exceeds a predetermined percentage, such as 95%, of the predetermined full speed. The constant speed of the positioner is established at its current speed if the positioner speed does not exceed the predetermined percentage of the predetermined full speed after a predetermined time period for acceleration. In addition, the calculated deceleration point can be compared to an average of the deceleration points for a plurality, such as three, of previous index cycles. If the calculated deceleration point for a current index cycle does not exceed the average deceleration point by a predetermined limit, the calculated deceleration point is used in further operations. Otherwise, the average deceleration point is used for further operations in a current index cycle. Thereafter, the average deceleration point is updated by averaging the deceleration point for the current cycle with the deceleration point for all of the plurality of previous index cycles except for the oldest previous index cycle.

The positioner can include an optical encoder associated therewith which generates a signal related to the speed and position of the positioner. The system can include limit switches for generating signals when the positioner is at the initial and final locations.

DESCRIPTION OF THE PREFERRED EMBODIMENTS

Figure 1:
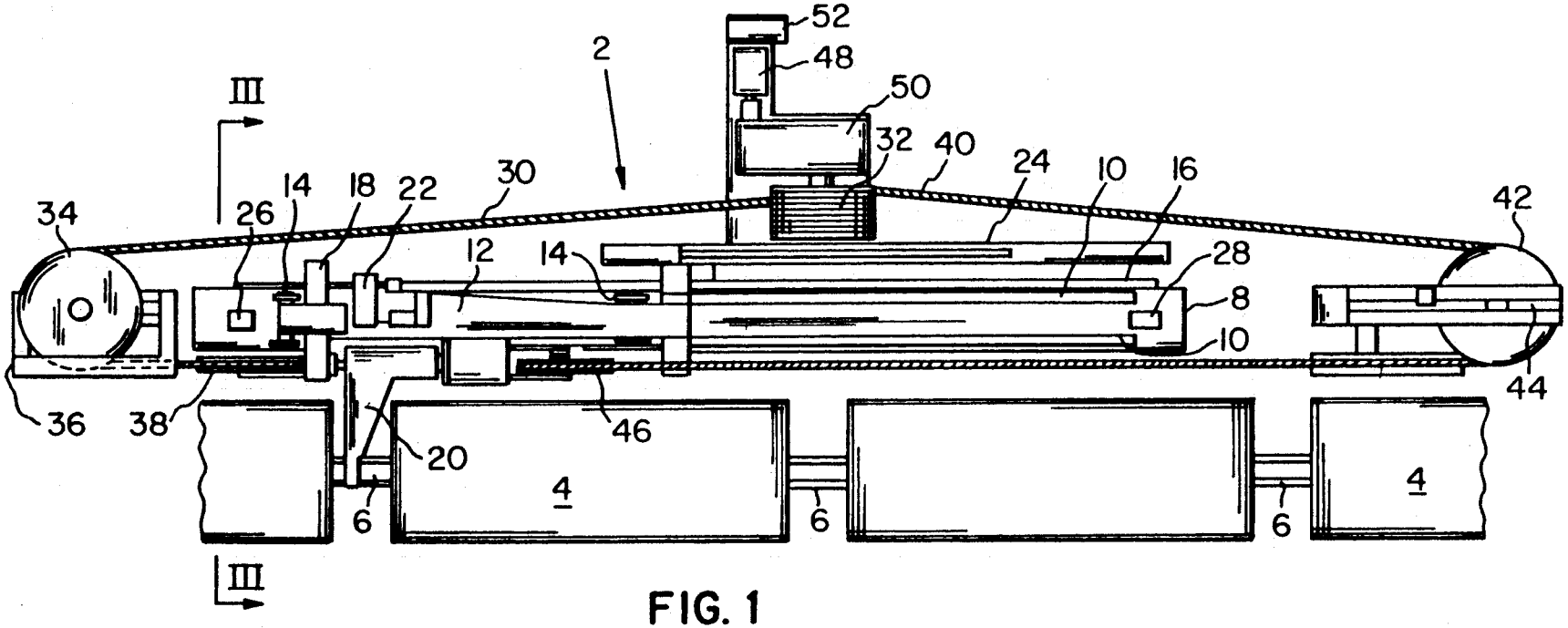
FIG. 1 PRIOR ART
FIG. 1 is a plan view of a prior art train positioner which can be used with the control arrangement of the present invention.
Figure 2:
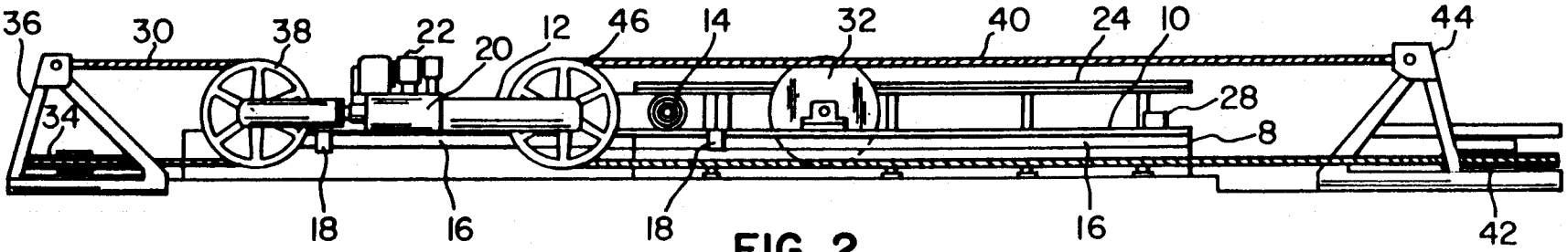
FIG. 2 PRIOR ART
FIG. 2 is a side view of the train positioner shown in FIG. 1.
Figure 3:
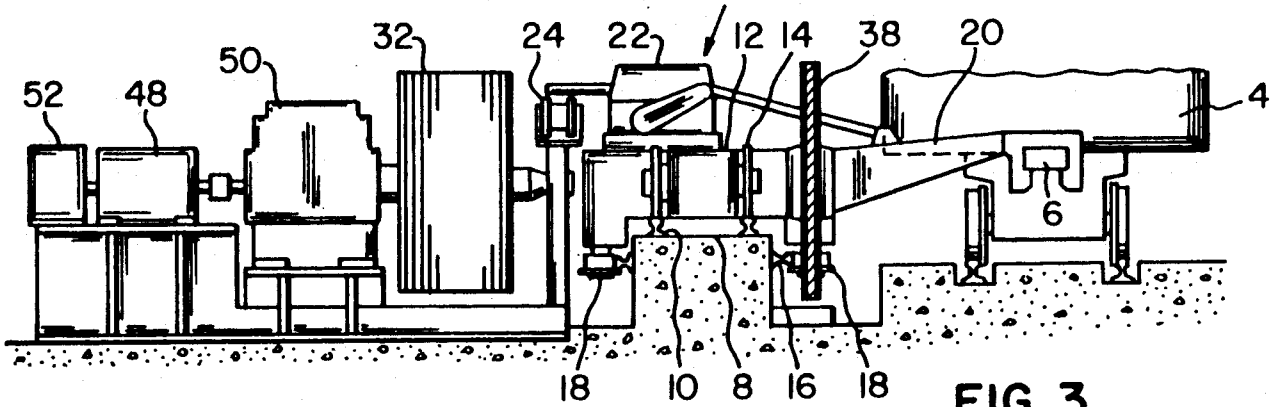
FIG. 3 PRIOR ART
FIG. 3 is a section taken along lines III—III in FIG. 1.

A cable based train positioner which can be operated with the control system of the present invention is shown in FIGS. 1–3. This train positioner is similar to that disclosed in U.S. Pat. No. 3,212,454. While a cable-based train positioner is shown in FIGS. 1–3, the control system of the present invention can also be readily used with any train positioners, including hydraulic train positioners, mechanical train positioners, and the like.

Referring once again to FIGS. 1–3, the train positioner 2 is shown positioned beside and generally parallel to a unit train formed of a plurality of railroad cars 4 joined together by couplers 6. The train positioner 2 includes an elongated carriage trackway 8 carrying a pair of upper carriage rails 10 thereon. A positioner carriage 12 is located above the carriage trackway 8 and rides on the upper carriage rails 10 by four carriage wheels 14. The carriage trackway 8 can also carry a pair of opposed, horizontal rails 16 which engage vertical stabilizer wheels 18 on the positioner carriage 12. The positioner carriage 12 carries thereon an elongated positioner arm 20 and a motor-based arm drive unit 22. The positioner arm 20 is moveable from a horizontal position, as shown in FIGS. 1 and 3, with its distal end engaged with a coupler 6, to a vertical position out of engagement with a coupler 6 and away from the railroad cars 4. The arm drive unit 22 obtains its operating power from an elongated power track 24 positioned along the carriage trackway 8. The positioner carriage 12 is moveable along the carriage trackway 8, generally between a front terminal bumper 26 and a rear terminal bumper 28 at opposite extremes thereof.

In order to move the positioner carriage 12 along the carriage trackway 8, an advancing cable 30 extends from a cable winding drum 32, around a head sheave 34 rotatably attached to a head sheave support 36 and around a head carriage sheave 38 rotatably attached to the front of the positioner carriage 12, and is anchored at a fixed location on the head sheave support 36. Similarly, a retracting cable 40 extends from the cable winding drum 32, around a tail sheave 42 rotatably attached to a tail sheave support 44 and around a tail carriage sheave 46 rotatably attached to the rear of the positioner carriage 12, and is anchored at a fixed location on the tail sheave support 44. An electric motor 48, typically a DC motor, rotates the cable winding drum 32 about a horizontal axis through a reducer 50 or the like. A brake 52 is also used to control the motor 48 and, hence, the cable winding drum 32. By appropriately rotating the cable winding drum 32, the advancing and retracting cables 30 and 40 will be reeved through the sheaves 34, 38, 42 and 46 and will move the positioner carriage 12 along the carriage trackway 8 in a desired direction and at a desired speed.

Figure 4:
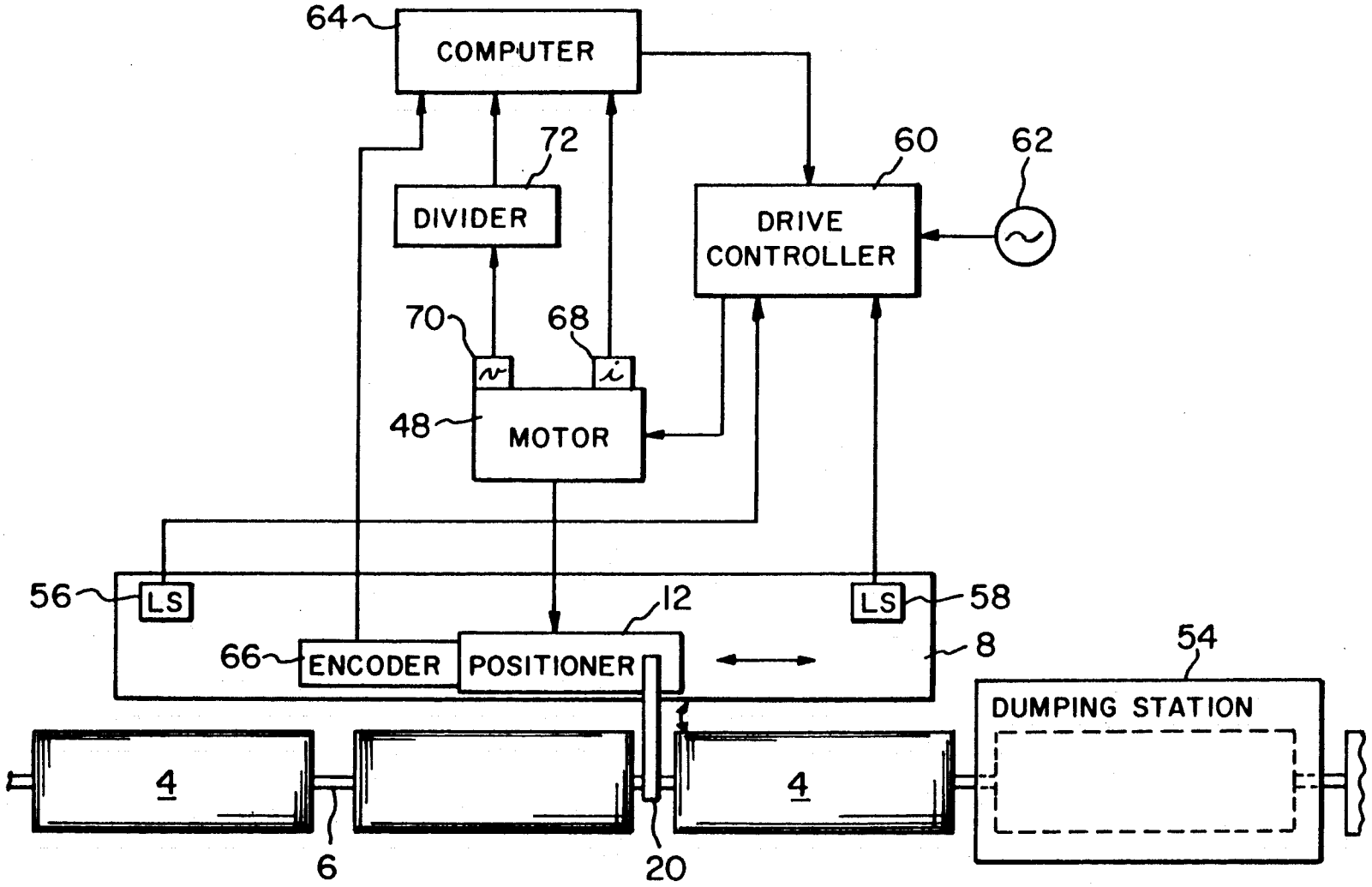
FIG. 4 is a plan view of a first embodiment of a control system for a train positioner in accordance with the present invention.

One embodiment of a control system for a train positioner in accordance with the present invention is shown in FIG. 4. The carriage trackway 8 is shown adjacent a dumping station 54. The positioner carriage 12, and its accompanying positioner arm 20, are shown in block diagram form on the carriage trackway 8. First and second limit switches 56 and 58, respectively, are positioned at opposite ends of the carriage trackway 8 and provide control signals for the initial and final locations of the positioner carriage 12 as it travels along the carriage trackway 8. The motor 48 provides the necessary force for operating the positioner carriage 12 in a known manner, such as that discussed above in connection with FIGS. 1–3. In addition, a standard drive controller 60 takes the input power supply 62 connected thereto and supplies control signals for operating the motor 48.

In accordance with the present invention, a computer 64, such as a microprocessor-based digital computer, is used to control the operation of the drive controller 60 and, hence, the motor 48 and the positioner carriage 12. An optical encoder 66 or the like is attached to or associated with the positioner carriage 12 and generates and supplies signals to the computer 64 relating to the speed of the positioner carriage 12 and its position along the carriage trackway 8. In addition, the currents and voltages developed by the motor 48 during its operation are measured through a current detector 68 and a voltage detector 70 associated therewith and signals relating thereto are supplied to the computer 64. Since the voltages and currents generated by the motor 48 may be rather large in normal operation (500 volts and 1500 amps), the signals developed by the voltage detector 70 and current detector 68 may be scaled down appropriately before being supplied to the computer 64. As shown in FIG. 4, the motor voltage measured by the voltage detector 70 is reduced by a divider 72 before it is supplied to the computer 64. The divider 72 operates to reduce the detected motor voltage to a lower 10 volt level suitable for use by the computer 64. Although not shown in FIG. 4, the motor current measured by the current detector 68 can, as is known in the art, be passed through a reducing shunt and then through a transducer before being supplied as a lower level signal to the computer. The transducer may transform the measured motor current to a 4–20 milliamp signal or a 10 volt signal, either of which may be suitable for use by the computer. In addition, the signals developed by limit switches 56 and 58 are supplied directly to the drive controller 60. As will be described hereinafter in more detail, the computer 64 takes the positioner carriage 12 speed and position signals developed by the optical encoder 66 and the voltage and current readings from the motor 48 and generates an appropriate control signal which is supplied to the drive controller 60 for operating the motor 48 and, hence, the positioner carriage 12.

Figure 5:
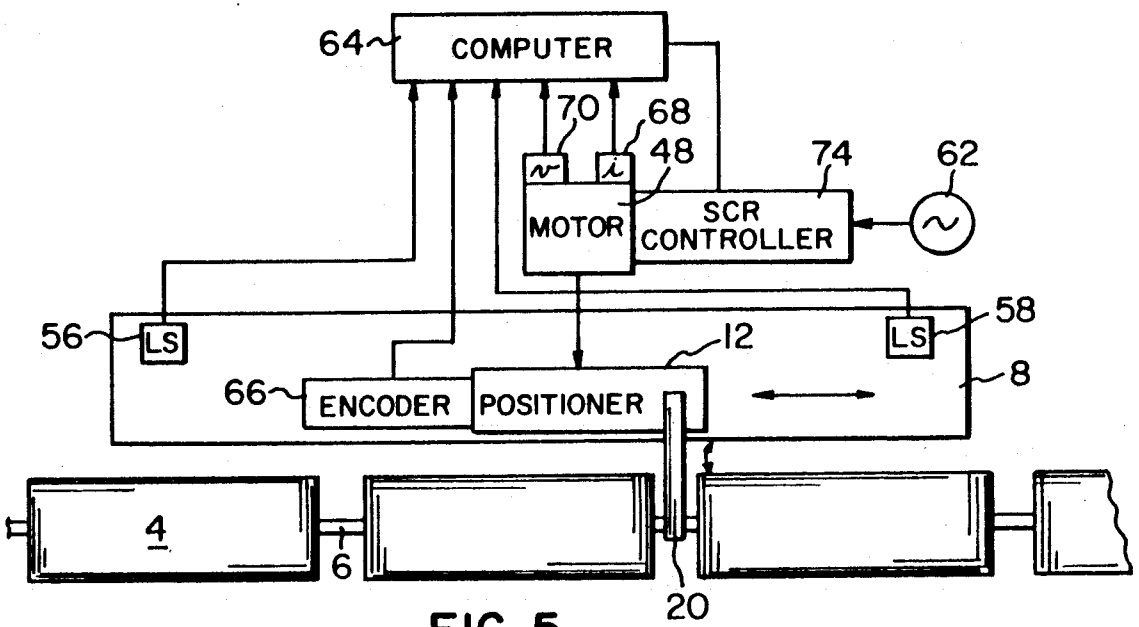
FIG. 5 is a plan view, similar to FIG. 4, of a second embodiment of a control system for a train positioner in accordance with the present invention.

The arrangement shown in FIG. 4 is particularly useful in retrofitting existing train positioners which have separate drive controllers. The arrangement shown in FIG. 5 is particularly suitable for new construction in which the control system of the present invention is built directly into a complete train positioner system. The arrangement shown in FIG. 5 is similar in many respects to that shown in FIG. 4 and includes a positioner carriage 12 moving on a carriage trackway 8 and controlled by a motor 48. An optical encoder 66 on the positioner carriage 12 supplies speed and position signals directly to the computer 64. Likewise, signals representing the current and voltage of the motor 48 are supplied directly to the computer 64 from the current detector 68 and voltage detector 70. However, in the arrangement shown in FIG. 5, the computer 64 directly controls an SCR controller 74 or the like associated directly with the motor 48. The signals developed by limit switches 56 and 58 are supplied directly to the computer 64. The electrical power from the input power supply 62 is fed directly to the SCR controller 74.

A computer suitable for use with the present invention is a Square D Model 600 PLC. The encoder 66 can be an incremental optical encoder, such as a BEI Model H40A, which generates a pair of square wave pulse trains which are 90° out of phase with each other. The encoder 66 is mounted to a fifth wheel attached to the positioner carriage 12 and generates approximately 150 pulses per revolution. An absolute type of optical encoder could also be used. The limit switches 56 and 58 at opposite ends of the carriage trackway 8 are not required in the present invention, but are preferred and are used to confirm the integrity of the position count generated by the encoder 66. If the signals generated by limit switches 56 and 58, which are at fixed and known locations, differ from the readings developed by the encoder 66, then the computer 64 can correct the readings from the encoder 66 to provide a precise and accurate reading over the length of the carriage trackway 8.

In order to understand the operation of the train positioner controller of the present invention, it is helpful to understand the basic overall operation of the train positioner. A typical train positioner index cycle includes the following sequential steps: (1) the unit train is first positioned by the locomotives; (2) the positioner arm is lowered onto the coupler between two of the railroad cars; (3) all blocking devices, including train brakes and wheel chocks, are released; (4) the train is indexed or moved forward by the positioner a distance of one car length to position the next car on the dumping station; (5) the wheel chocks are engaged and the positioner arm is raised to a vertical position; (6) the dumper starts emptying the car in the dumping station while the positioner returns, one car length, to its initial position; (7) the positioner arm is lowered onto the coupler between the next pair of cars, as in step (2) above; and (8) after the current car in the dumper has been emptied and returned to its original position, steps (3)–(7) are repeated until the entire unit train has been moved through the dumping station and all cars have been unloaded. A similar sequence of steps would be followed if the train were sequentially passed through a loading station or other device.

The operation of the control system of the present invention can be explained with reference to the flow chart of FIGS. 6A and B. This invention basically operates only during indexing step (4), described above, of the complete operating cycle. The indexing cycle includes that period of time when the train is accelerated from a stopped position to full speed, moved forward by an appropriate distance, decelerated and brought to a complete stop. The total indexing distance of the train must remain very close to one car length or the next car will not be positioned properly in the dumping station. The operating system of the present invention compensates for the forces developed during the indexing operation and for the changing mass of the train in each indexing cycle by measuring the forces involved and adjusting the deceleration rate and deceleration point for each index cycle of the operation of the train positioner.

Figure 6A:
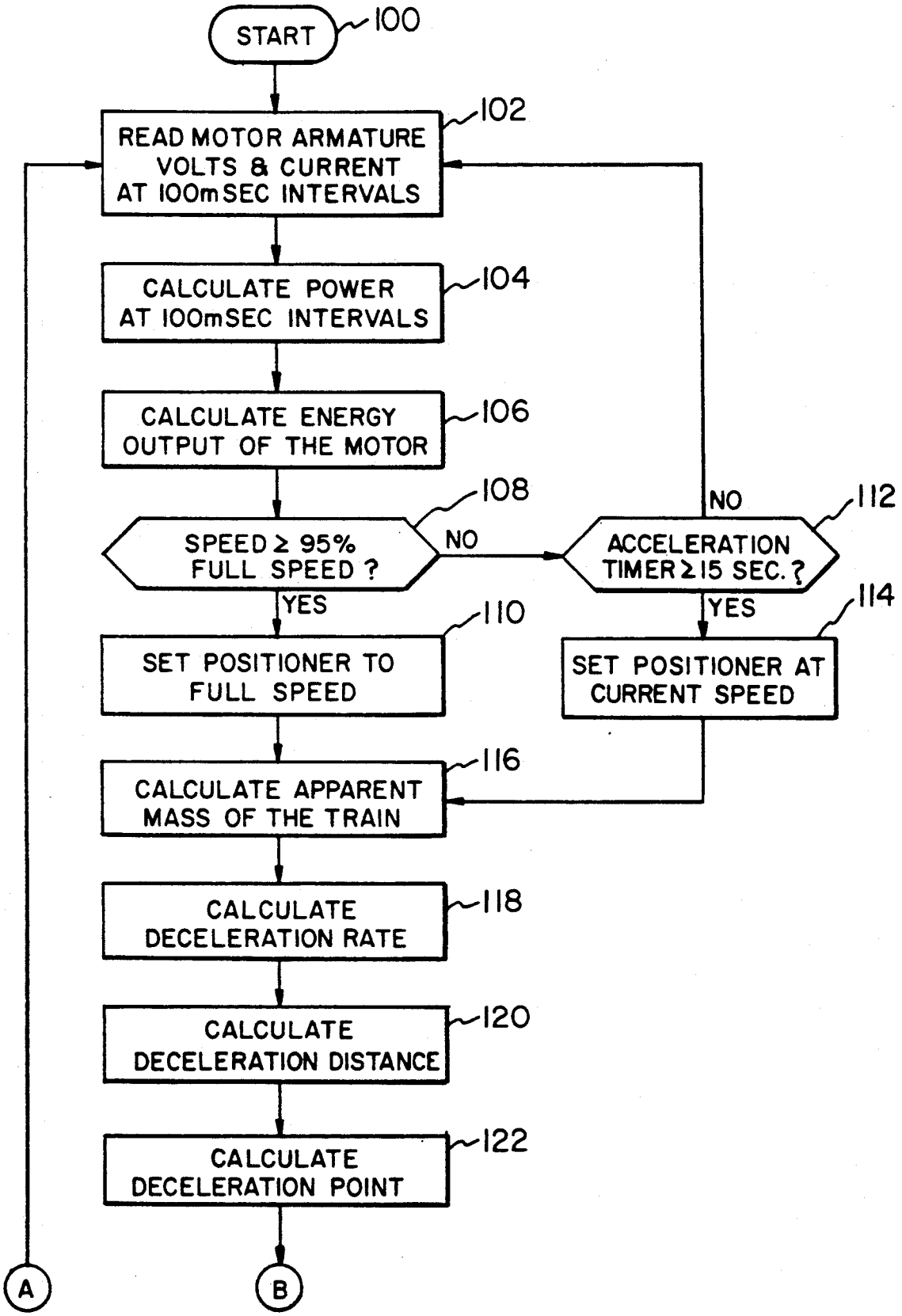
FIGS. 6A and 6B are flow charts of a control program used in the train positioner control system shown in FIGS. 4 and 5.
Figure 6B:
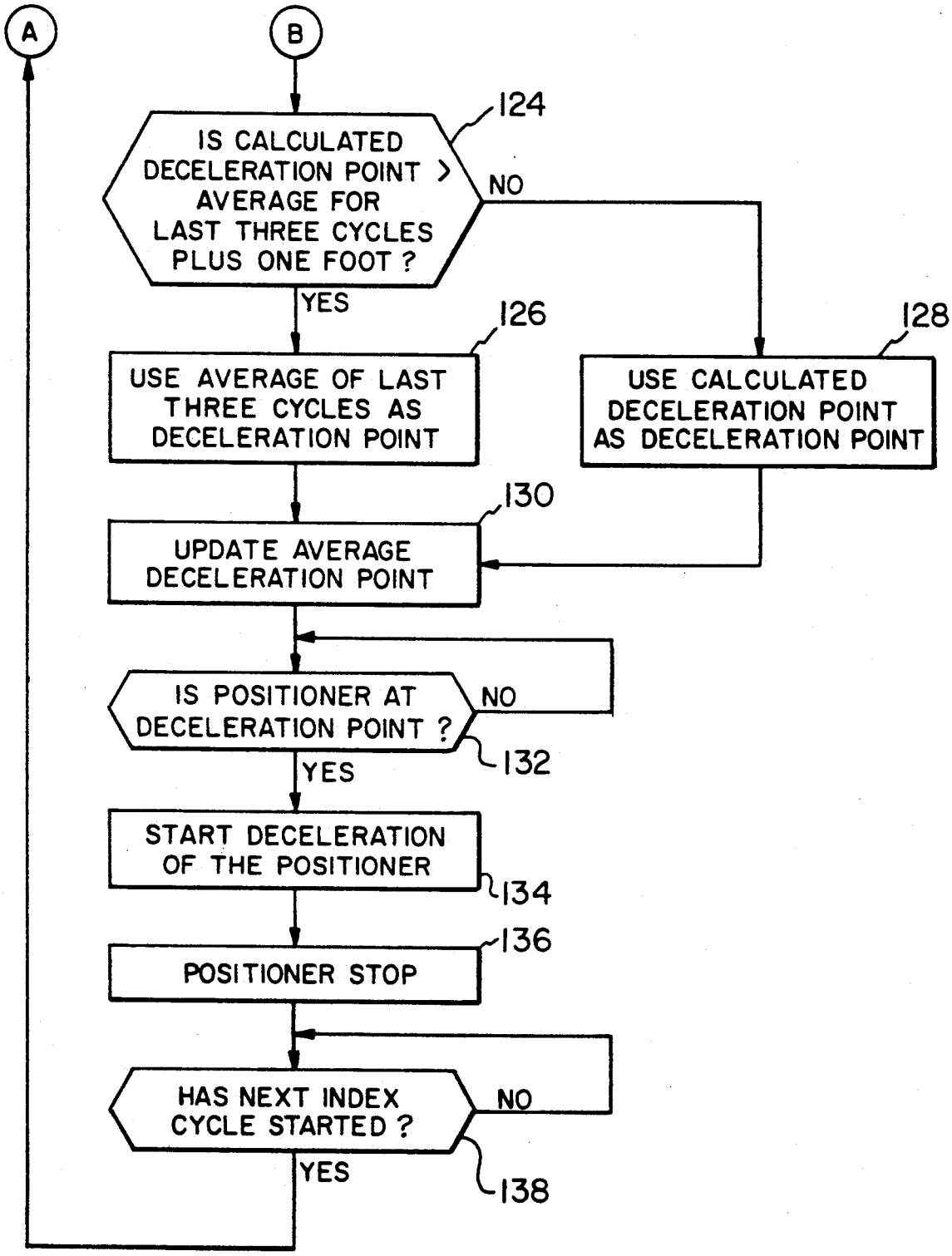

With continued reference to FIGS. 6A and B, the operation of the present invention is initiated at block 100 when the index cycle of the train positioner begins. The motor is started and operates to move the positioner carriage along the carriage trackway in the standard manner. While the motor is accelerating and the positioner carriage is moved from its initial, stopped position to a constant speed of motion, the voltage and current developed in the motor armature are measured and supplied to the computer at block 102. These readings are taken at 10 msec intervals so that the computer is not inundated with information. Samplings at 10 msec intervals are sufficient as shown at block 104. The instantaneous power of the motor is calculated at each 10 msec interval in accordance with the equation:

$$\text{power} = \text{voltage} \times \text{current}.$$

By integrating the calculated power of the motor over time, the energy expended to accelerate the positioner carriage and the loaded train by a certain distance can be calculated at block 106. The speed and position of the positioner carriage are continuously monitored as discussed above. As shown at block 108, if the speed of the positioner carriage has reached or exceeded 95% of a predetermined full speed, the positioner carriage is then run at the predetermined full speed at block 110. If the speed of the positioner carriage has not yet reached 95% of full speed, then an acceleration timer is checked at block 112. If the acceleration timer shows that a predetermined period of time, here 15 seconds, of acceleration has taken place, and the positioner carriage has not reached at least 95% of full speed, then the speed of the positioner carriage is fixed at block 114 at its current speed for its constant speed operation in the balance of that present index cycle. If the acceleration timer does not show an elapsed acceleration time greater than or equal to the preset time, the positioner carriage continues to accelerate, the motor armature current and voltage readings are taken at block 102, the power is calculated at block 104, the energy output of the motor is calculated at block 108 and the speed of the positioner carriage is monitored at block 108.

It is known that the energy expended to accelerate an object to a final speed is given by the equation:

$$E = \frac{MV^2}{2}$$

where,

E is the energy expended during acceleration,

M is the mass of the object, and

V is the final speed of the object.

Since the energy expended during acceleration and the final speed of the positioner carriage after going through acceleration have been determined as discussed above, the apparent mass of the train can be calculated at block 116 using the equation set forth immediately above. The final speed is either the predetermined full speed reached at block 110 or the current speed reached at block 114 after accelerating for the maximum acceleration time period. The calculated mass is referred to as the "apparent" mass of the train because it is the mass as seen by the positioner. This mass depends on a number of factors, such as actual train mass, the couplings, and track grades, and it will change every time a car is emptied or loaded. However, for purposes of the present system, the apparent mass is sufficient to perform the subsequent control operations for the system.

With the apparent mass of the train calculated at block 116, and by establishing the maximum deceleration force to which the positioner carriage should be subjected, which is a characteristic of each particular train positioner, the deceleration rate necessary to bring the positioner carriage to a stop within a particular index cycle can be calculated at block 118 using the equation:

$$\text{Force} = \text{mass} \times \text{acceleration (or deceleration)}.$$

The deceleration rate is determined by dividing the maximum force for the positioner carriage by the apparent mass of the train seen by the positioner carriage.

Once the deceleration rate has been determined, the distance needed to slow the positioner carriage from its constant, final speed of operation to a full stop is calculated at block 120 using the equation:

$$D = \frac{V^2}{2A}$$

where,

D = deceleration distance,

V = final speed, and

A = deceleration rate.

The deceleration point is calculated at block 122 by subtracting the final and desired stopping location on the carriage trackway from the calculated deceleration distance. A fixed safety factor, such as a three foot distance, can be added to the calculated deceleration distance. Basically, the deceleration point is the point at which the positioner must start decelerating the positioner carriage at the calculated deceleration rate to stop the current mass of the train in the calculated distance before reaching the final and stopped position for the positioner carriage.

If a train is being unloaded, the deceleration point should move further and further toward the stopped position for the positioner carriage since the train is gradually becoming lighter. This distance should gradually change and should not change by a great amount in any particular index cycle. In order to make sure that radical changes are not taking place in the operation of the train positioner, the calculated deceleration point in a current index cycle is compared against several of the immediately preceding deceleration points and a maximum allowable change per cycle. In a preferred embodiment, the calculated deceleration point in a current cycle is compared at block 124 against the deceleration points for three immediately prior cycles. If the calculated deceleration point in the current cycle is greater than the average of the deceleration point for the three prior cycles, plus a preset distance, such as a one foot distance, then control is passed to block 126 and the average of the deceleration points for the previous three cycles is used as the deceleration point in the current cycle. This flow path in the flow chart indicates that the expected gradual change in the deceleration point has not taken place in a particular index cycle. If normal or expected changes are taking place, the calculated deceleration point for a particular cycle will be less than or equal to the average of the deceleration points for the last three cycles, plus the one foot preset distance, and control of the system will pass to block 128 where the calculated deceleration point is used as the actual deceleration point for further operations. In any event, the deceleration point selected at either block 126 or block 128 is used to generate a new average deceleration point at block 130, which is the average of the deceleration point used in the present cycle and the previous two cycles.

After the deceleration point for the present cycle has been determined at block 126 or block 128, and the average deceleration point has been determined at block 130 and stored for use in the next index cycle, the computer monitors at block 132 whether the positioner carriage has reached the deceleration point for the current cycle. Once the deceleration point has been reached, control passes to block 134 and the computer operates the motor to decelerate the positioner carriage in accordance with the deceleration rate calculated above. When the positioner carriage has reached the final position, control passes to block 136 and the positioner carriage is brought to a complete stop. In accordance with standard operation of a train positioner, the positioner carriage will then be returned to the initial, starting location. Control then passes to block 138 and the system determines if the next index cycle has started. When the next index cycle has started, control is passed to block 102 and the operation discussed above is repeated.

In order to start operation of the present invention, a default deceleration point is pre-programmed into the computer and is set to be at a safe position even for heavy trains. This point is used for the first several index cycles of the train until several actual deceleration points have been calculated. Thereafter, the deceleration point is calculated for each cycle and is compared to the average of three prior calculated deceleration points for further operation.

As a train is unloaded or loaded, the forces required by a train positioner to move the train will decrease or increase, respectively. The control system of the present invention adjusts for this change every time the train is moved. The required acceleration and deceleration times are also changed as the train is unloaded or loaded. This arrangement permits the positioner to remain at the greatest possible speed for the longest possible time during each index cycle. The overall time of constant and high speed operation is increased as the acceleration and deceleration times are decreased, therefore, decreasing the overall cycle time of the positioner for each index cycle. This compares sharply with prior systems which had a fixed cycle time for each index cycle. Since the deceleration rate and distance are calculated for each cycle, the present system ensures that the positioner stops at the proper location each time the train is moved. The introduction of slackless couplings to trains has added a great amount of stress to the existing positioners that were designed for standard couplings. This stress can be reduced or even eliminated by adjusting the deceleration rate according to the forces seen by the positioner and not by predetermined limits. The present invention makes this adjustment for each cycle of the positioner, therefore allowing the use of slackless couplings without decreasing the life of the positioner. In addition, when the mass of the train becomes very low, such as toward the end of an unload cycle, the rate of deceleration can be made very steep and fast. In a simplified arrangement of the present invention, the deceleration rate would be kept constant except when the mass of the train becomes very low. In this arrangement, the deceleration rate would be slow enough to not damage the positioner when the train is fully loaded.

Having described above the presently preferred embodiments of the present invention, it is to be understood that the invention may be otherwise embodied within the scope of the appended claims.

I claim:

1. A method of controlling the operation of a train positioner moving at least one railroad car of a unit train, said method comprising, for each index cycle of the positioner, the steps of:

a. engaging the positioner with the train while the positioner is stopped at an initial location;

b. moving the positioner and accelerating the train to a constant speed;

c. determining the energy expended by the positioner in accelerating the train to the constant speed and calculating therefrom the apparent mass of the train;

d. calculating, from (i) the apparent mass of the train, (ii) a maximum force to which the positioner should be subjected and (iii) a deceleration rate, a deceleration point adequate to stop the train by a predetermined final location; and e. initiating deceleration of the positioner at the deceleration point and decelerating the train at the deceleration rate until the train is stopped by the final location.

2. The method of claim 1 wherein the deceleration rate is calculated from the apparent mass of the train and the maximum force to which the positioner should be subjected.

3. The method of claim 2 wherein the energy expended by the positioner in accelerating the train to the constant speed is determined by measuring, over the time period of acceleration, the power expended by a motive power source for the positioner.

4. The method of claim 3 wherein the motive power source is an electric motor and the energy expended by the motor is determined by measuring the current and voltage of the motor, multiplying the current and voltage to give the power of the motor, and integrating the measured motor power over the time period of acceleration.

5. The method of claim 3 wherein the apparent mass of the train is calculated from the equation:

$$E = \frac{MV^2}{2}$$

where,

E is the energy expended in accelerating the train to the constant speed,

M is the apparent mass of the train, and

V is the constant speed of the positioner.

6. The method of claim 5 wherein the deceleration rate is calculated from the equation:

$$F = M \times A$$

where,

F is the maximum force to which the positioner should be subjected,

M is the apparent mass of the train, and

A is the deceleration rate.

7. The method of claim 6 wherein the deceleration point is determined by calculating a deceleration distance from the positioner's desired final location, with the deceleration distance calculated by the equation:

$$D = \frac{V^2}{2A}$$

where,

D is the deceleration distance,
V is the constant speed of the positioner, and
A is the deceleration rate.

8. The method of claim 7 wherein the deceleration point is determined by adding a safety distance to the calculated deceleration distance.

9. The method of claim 3 further including the steps of monitoring the speed of the positioner and establishing the constant speed of the positioner at a predetermined full speed if the measured speed of the positioner exceeds a predetermined percentage of the predetermined full speed or establishing the constant speed of the positioner at its current speed if the positioner speed does not exceed the predetermined percentage of the predetermined full speed after a predetermined time period for acceleration.

10. The method of claim 3 wherein the calculated deceleration point is compared to an average of the deceleration points for a plurality of previous index cycles, and if the calculated deceleration point for a current index cycle does not exceed the average deceleration point by a predetermined limit, the calculated deceleration point is used in further operations, otherwise the average deceleration point is used for further operations in a current index cycle.

11. The method of claim 10 further including the step of updating the average deceleration point by averaging the deceleration point for the current cycle with the deceleration points for all of the plurality of previous index cycles except for the oldest previous index cycle.

12. A method of controlling the operation of a train positioner moving at least one railroad car of a unit train, said method comprising the steps of:

a. engaging the positioner with the train while the positioner is stopped at an initial location;
b. moving the positioner and accelerating the train to a constant speed;
c. measuring the constant speed of said train as reached in step (b) above;
d. determining the energy needed to accelerate the train to the constant speed;
e. determining, from the constant speed measured in step (c) and the energy determined in step (d), the apparent mass of the train moved by the positioner;
f. calculating, from the apparent train mass determined in step (e) and a maximum force to which the positioner should be subjected, a deceleration point and a deceleration rate for the positioner adequate to stop the train by a predetermined final location;
g. decelerating the positioner beginning at the deceleration point and at the deceleration rate calculated in step (f) above;
h. after the train has completely stopped, disengaging the positioner from the train and moving the positioner to the initial location; and
i. repeating steps (a)–(h) above for each index cycle of the positioner.

13. Apparatus for controlling the operation of a train positioner moving at least one railroad car of a unit train comprising:

a. means for engaging the positioner with the train while the positioner is stopped at an initial location;
b. means for moving the positioner and accelerating the train to a constant speed;
c. energy means for determining the energy expended by the positioner in accelerating the train to the constant speed and for calculating therefrom the apparent mass of the train;
d. means for calculating, from (i) the apparent mass of the train, (ii) a maximum force to which the positioner should be subjected, and (iii) a deceleration rate, a deceleration point adequate to stop the train by a predetermined final location; and
e. means for initiating deceleration of the positioner at the deceleration point and decelerating the train at the deceleration rate until the train is stopped by the final location.

14. The apparatus of claim 13 further including means for calculating the deceleration rate from the apparent mass of the train and the maximum force to which the positioner should be subjected.

15. The apparatus of claim 14 wherein the energy means includes a means for measuring, over the time period of acceleration, the power expended by a motive power source for the positioner.

16. The apparatus of claim 15 wherein the motive power source is an electric motor and the energy means includes means for measuring the current and voltage of the motor, multiplying the current and voltage to give the power of the motor, and integrating the measured motor power over the time period of acceleration.

17. The apparatus of claim 15 wherein the apparent mass of the train is calculated from the equation:

$$E = \frac{MV^2}{2}$$

where,
E is the energy expended in accelerating the train to the constant speed,
M is the apparent mass of the train, and
V is the constant speed of the positioner.

18. The apparatus of claim 17 wherein the deceleration rate is calculated from the equation:

$$F = M \times A$$

where,
F is the maximum force to which the positioner should be subjected,
M is the apparent mass of the train, and
A is the deceleration rate.

19. The apparatus of claim 18 including means for determining the deceleration point by calculating a deceleration distance from the positioner's desired final location, with the deceleration distance calculated by the equation:

$$D = \frac{V^2}{2A}$$

where,
D is the deceleration distance,
V is the constant speed of the positioner, and
A is the deceleration rate.

20. The apparatus of claim 19 wherein the deceleration point is determined by adding a safety distance to the calculated deceleration distance.

21. The apparatus of claim 15 further including means for monitoring the speed of the positioner and establishing the constant speed of the positioner at a predetermined full speed if the measured speed of the positioner exceeds a predetermined percentage of the predetermined full speed or establishing the constant speed of the positioner at its current speed if the positioner speed does not exceed the predetermined percentage of the predetermined full speed after a predetermined time period for acceleration.

22. The apparatus of claim 14 wherein said positioner includes an optical encoder associated therewith which generates a signal related to the speed and position of the positioner.

23. The apparatus of claim 14 further including limit switch means for generating signals when the positioner is at the initial and final locations, respectively.

* * * * *